United States Patent [19]

Zabroski

[11] 4,410,835

[45] Oct. 18, 1983

[54] UTILITY EMERGENCY LAMP AND SOLID STATE SWITCHING AND BATTERY CHARGING CIRCUIT THEREFOR

[76] Inventor: Stanley E. Zabroski, 910 N. G St., Oxnard, Calif. 93030

[21] Appl. No.: 250,033

[22] Filed: Apr. 1, 1981

[51] Int. Cl.[3] ..... H05B 39/10

[52] U.S. Cl. ..... 315/87; 307/66; 315/65; 315/67; 315/92; 362/20; 362/211

[58] Field of Search ..... 315/65, 67, 86, 87, 315/92; 307/23, 66; 340/46; 362/20, 211, 256

[56] References Cited

U.S. PATENT DOCUMENTS 3,573,541 4/1971 Dunn et al. ..... 315/87
3,976,986 8/1976 Zabroski ..... 307/66 X

FOREIGN PATENT DOCUMENTS 900566 10/1944 France ..... 362/20
52-73575 6/1977 Japan ..... 315/87

*Primary Examiner*—Eugene R. LaRoche

[57] ABSTRACT

The power/switcher module, bi-filament light bulb, and light bulb socket, of this invention are assembled with standard lamp industry hardware and fittings to provide a lamp fixture with conventional utility increased by the addition of an integrated automatic emergency lighting capability. Normal ON/OFF use of the lamp, while connected to household line current, also provides light bulb filament current for maintaining a full charge on a rechargeable storage battery. The loss of charging current through line current power failure, filament burn out, or selective disconnection by removal of the portable cord, immediately switches on the other filament to battery power, extending the emergency use to that of a portable lantern. Restoration of line current and/or a burned out filament automatically reverts the lamp to normal operation. The foregoing capabilities are made available in practical quantitive measure, less than costly and bulky industrial and commercial units, but substantially more than the very limited usefulness available from existing household plug-in, receptacle mounted counterparts.

5 Claims, 6 Drawing Figures

UTILITY EMERGENCY LAMP AND SOLID STATE SWITCHING AND BATTERY CHARGING CIRCUIT THEREFOR

FIELD OF INVENTION

This invention relates to certain conventional household lamps and specifically to the integration of an automatic and substantial emergency lighting function therein.

CROSS-REFERENCE TO RELATED APPLICATIONS

U.S. Pat. No. 3,976,986 of Aug. 24, 1976 Zabroski. The solid state switching circuit of the referenced patent is essential to some embodiments of the invention described herein.

DISCUSSION OF PRIOR ART

The commercial and industrial use of battery operated emergency lamps is well established. Typically such devices are permanently installed and connected to the line voltage normally available within the plant or office building and include a relatively powerful lamp(s) energized by a large and bulky storage battery. The battery, for example, may be a bank of wet cells, and the device may provide for automatically maintaining the proper charge, as well as switching it ON in the event of power failure.

The large size, high cost, and special mounting of these known emergency light sources renders them impractical for home use. Recent product development has generated a number of relatively very small emergency receptacle-supported lamps which operate on relatively similar principles, but actually have no functional value aside from the emergency or portable handlight modes of operation. In addition, the aforementioned receptacle supported lamps are very limited in the quantity of emergency light available, nominally one half watt, as well as the length of time they can function, nominally less than one hour, in the emergency mode. At best, the presently available emergency lamps for home use offer only a token usefulness, generally inadequate for effective emergency use.

Accordingly, it is desirable to provide a utility emergency lamp for the home, office, or waiting room, combining in one conventional lamp fixture, all the utility of a conventional 120VAC lamp, with automatic and substantial emergency light for a substantial period of time, in the event of power failure. The value of such a dual function lamp is particularly apparent for situations where power "blackouts" can or are likely to occur.

OBJECTS

In accordance with the above, several objects of this invention are to provide:

A low cost, convenient utility lamp adapted for connection to a normally available source of electrical power, such as household line voltage, wherein a substantial emergency light source, nominally six(6) watts, is automatically energized in the event of a power loss.

A utility emergency lamp in the form of a conventional table lamp is normally useful in HIGH, LOW, and OFF modes, when there is no power outage. Such a lamp is detachably plugged into a standard household electrical receptacle, by means of a removeable portable cord which can also be disconnected from the lamp to permit it to be carried about as a portable battery powered lantern, when it automatically reverts to the EMERGENCY mode because of line power interruption.

The above lamp with a rechargeable storage battery which is continuously charged, by the normally available power source, such that the battery is always maintained in a fully charged condition to a capacity capable of several hours emergency use.

Maximum lamp component parts compatibility with industry standards in order to minimize tooling and dye modifications for light bulbs, sockets, fittings, harps, shades, plugs, bases, etc.

A very small, nominally less than 1 cubic inch, simple, low cost, reliable solid state switching and battery charging circuit to continuously charge a storage battery through one filament of a bi-filament and bi-voltage light bulb, while maintaining the other filament unenergized in response to the continued presence of an external source of power, e.g., household or line voltage; and for energizing the latter filament from the battery in the event of loss of such power, regardless wether the the lamp had been functioning in the HIGH, LOW, or OFF mode, immediately prior to the power failure.

A portable utility emergency lamp having the foregoing characteristics in which the lamp is selectively and positively energized in the emergency mode by detaching the portable cord from an external power source, such that no electro-mechanical switch is either required, nor desired in order to preclude inadvertent erratic manipulation of same.

A battery charging circuit which will utilize the heat dissipating function of the 120VAC filament of the bi-filament and bi-voltage light bulb to control the relatively critical battery charging rate, while simultaneously providing the HIGH or LOW levels of illumination for the lamp under non-emergency use, and in order to preclude the need for transformer operated battery charging sub-systems, heat sinks or other means to dissipate heat emission characteristic of the relatively large voltage drops inherent in this circuit function.

A bi-filament, bi-voltage light bulb with one 120VAC filament and one 6VDC filament, one pole-terminal connection common to both, and mounted in a standard three(3) pole light bulb screw-base.

A standard three(3) pole lamp socket, with direct connections from the screw-thread, ring, and button, to corresponding screw terminal posts.

The above lamp socket, but with the addition of an integral SPDT w/OFF switch and three additional corresponding screw terminal posts; the switch using either a "slide," or "rotary" mechanism.

A power/switching module, including the above functions, and with or without the bi-filament light bulb and socket, for availability to the lamp industry to install in lamps of various configurations.

Other embodiments of this invention, e.g., the external power subject to failure, may be either the alternating current line voltage referred to above, or a direct current source such as provided by dc line voltage on marine or aircraft.

A convenient hand-hook at the top of the lamp fixture, or equivalent hoop-ring, to facilitate carrying the lamp as a lantern, or suspending it similar to a swag lamp; the latter suspension also including the appropriate portable cord detachable from the lamp base.

These and further objects and various advantages of the utility emergency lamp and solid state switching and battery charging circuit according to this invention will become apparent to those skilled in the art from a consideration of the description and appended drawings of certain exemplary embodiments thereof.

DESCRIPTION

Figure 1:
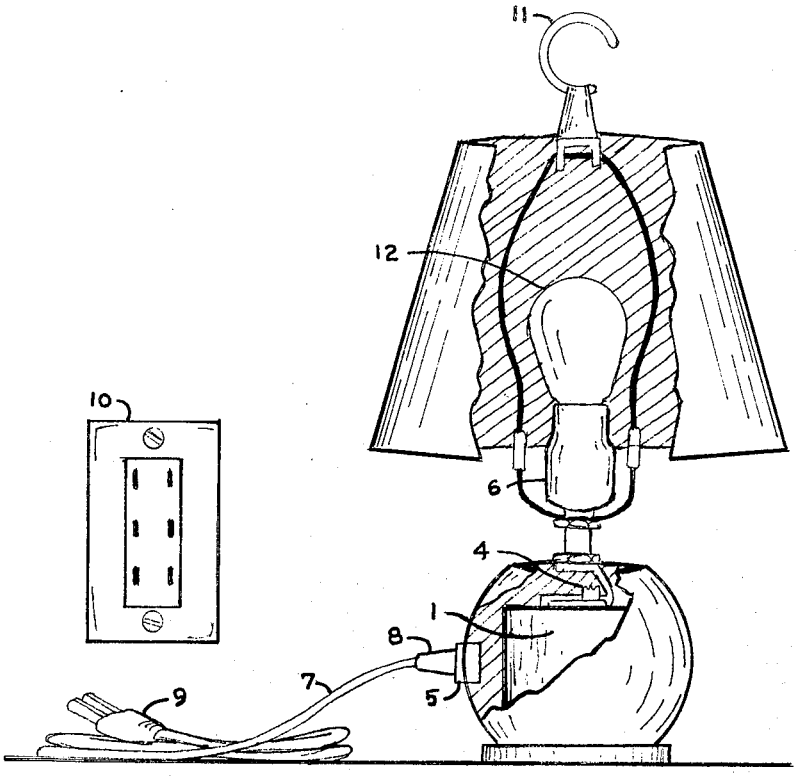
FIG. 1 A cut-away perspective drawing of one typical utility emergency lamp embodiment identifying its major elements, particularly the module mounted SPDT w/OFF manual switch.
Figure 2:
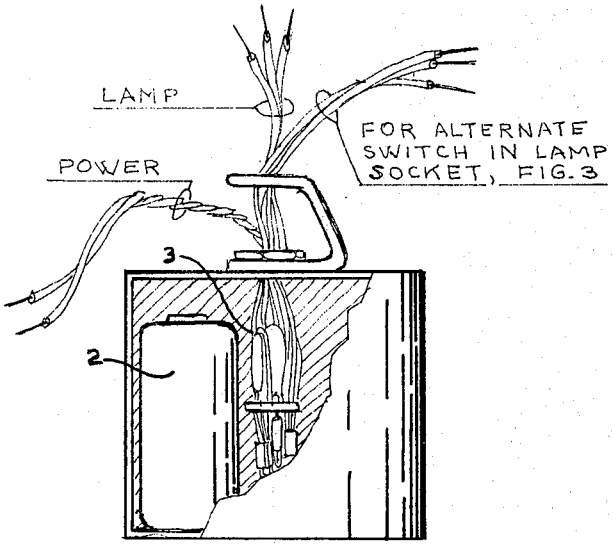
FIG. 2 A cut-away perspective drawing of the utility emergency lamp power/switching module, identifying its major elements, such as battery cells (only one cell shown), lamp socket support bracket, and wiring for the alternate SPDT w/OFF switch location in lamp socket base.
Figure 3:
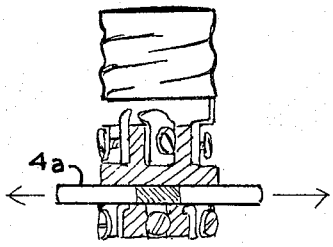
FIG. 3 A cut-away perspective drawing of alternate bi-filament light bulb socket with electrically separate but physically integrated SPDT w/OFF switch for accommodation inside standard socket shell. An equivalent embodiment (not shown) would be a rotary switch with ON 1-OFF-ON 2-OFF switching sequence.

With reference to FIGS. 1, 2, and 3, for the utility emergency lamp embodiments described herein, and consistent with the object of maximum conformity and adaptability to lamp industry standards and practices, FIG. 1 represents a conventional table lamp in all respects, except for those differences which follow.

The utility emergency lamp power/switcher module 1 consists of a cylindrical (in this embodiment) container for housing a number of Nickel Cadmium rechargeable storage battery cells 2, only one of which is shown for clarity. The cells being arranged in a circular pattern, the space in the center is utilized for suspending the solid state switching and battery charging control circuit board assembly 3, adequately supported by the wire harness consisting of external connections to the manual switch 4, the recessed male receptacle 5 mounted in the lamp base, and the three(3) pole light bulb socket 6, which is shown to not contain a switch. Also shown is the detachable at both ends portable cord 7, with female plug 8, for attachment to receptacle 5, and a male plug 9 for making connection to a standard electrical convenience outlet receptacle 10, for a source of 120VAC. Affixed to the top of the lamp shade harp is a hand-hook 11, to facilitate the portable handling of the utility emergency lamp as a portable lantern. Bi-filament bi-voltage light bulb 12 is common to the industry in that the number of filaments, the three(3) pole threaded base, and the glass envelope are standard; however, it is unique in that primary filament 13 (FIG. 4) operates on 120VAC, whereas the other emergency filament 14 (FIG. 4), which shares a common conductor with the primary filament 13, operates on 6VDC. There are many established filaments for these voltages currently available in the industry, and no significant problem in mass producing a bi-voltage bi-filament light bulb is anticipated; this even including a physical and/or visual marker to readily distinguish a bi-voltage light bulb from a single voltage light bulb. Light bulb socket 6 is shown without a manual switch, since this embodiment utilizes switch 4 mounted in power/switcher module 1. Lamp socket 6 is also standard to the industry insofar as the shell, insulation, mechanical mounting provisions, female threaded screw base, and ring and button contacts are concerned; however, the integrated direct electrical connection of the three contact points directly to three corresponding screw terminals, without a switch is unique, and is portrayed in the upper portion of FIG. 3. For alternate and preferred installations, the combined socket and slide switch **4*a* is shown in FIG. 3; the choice of switch and location 4, FIG. 1 v.s. 4*a* in FIG. 3 would appear to depend on such considerations as overall lamp configuration, parts cost, etc. It is reasonable that the power/switcher modules 1 could be produced and furnished to the lamp industry with or without switches 4. It is also reasonable that socket FIG. 3 could be produced without a switch, or with switch 4*a***; the latter could be either a slide mechanism as shown, or a rotary mechanism with HIGH - OFF - LOW - OFF throws, not shown. It is noted at this point, that there is no manual switch provision for the EMERGENCY mode which is fully automatic and positive to the extent that it is impossible to manually and conveniently disable the EMERGENCY function, deliberately, or inadvertantly, rendering it unavailable when a critical emergency does occur; should it become necessary to disable the emergency operation as in shipping, storage, or to interrupt continuous emergency use in order to extend the substantial capacity of the battery beyond several hours, it is necessary to manually unscrew the light bulb sufficiently in its socket, to break the electrical contact of the light bulb with the socket. On returning the utility emergency lamp to regular service, it will be obvious to require screwing the light bulb in, to resume operation.

From the foregoing, it is apparent that the utility emergency lamp is initially a regular convenient table lamp for normal use during most of the time and space it occupies, including its utility as a portable lantern in locations removed from access to 120VAC or other external power source; the substantial end reliable emergency capability, in terms of higher light levels and longer duration over other non industrial/commercial counterparts are considered to provide a significantly more effective device which is unique to the current art.

Circuit considerations related to typical Radio Frequency Interference suppression are omitted from this specification as a matter of designer option related to particular product design.

OPERATION

Figure 4:
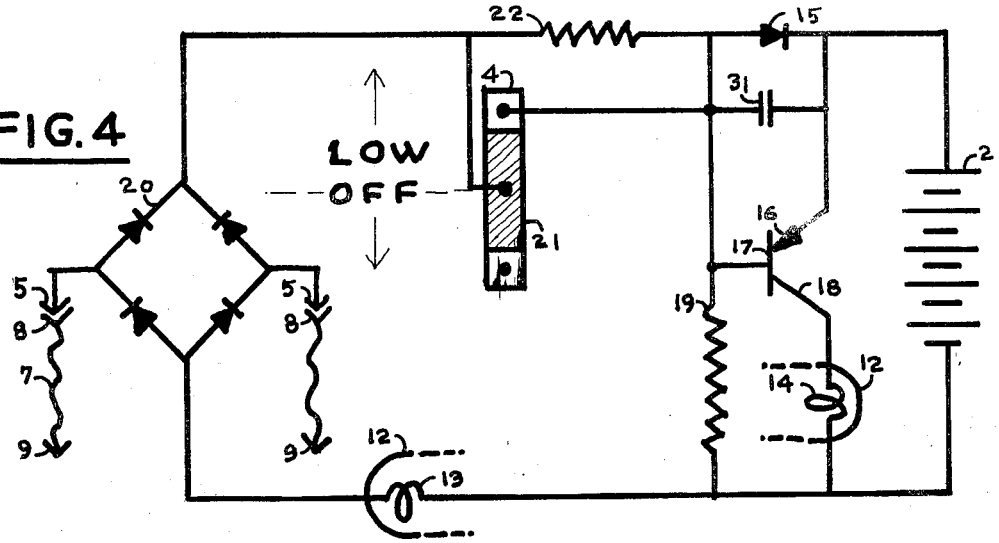
FIG. 4 A schematic drawing of the basic solid state switching and battery charging circuit identifying filament illumination and charging function, common glass envelope and three pole base, for a lamp embodying the LOW, OFF, and EMERGENCY modes.
Figure 5:
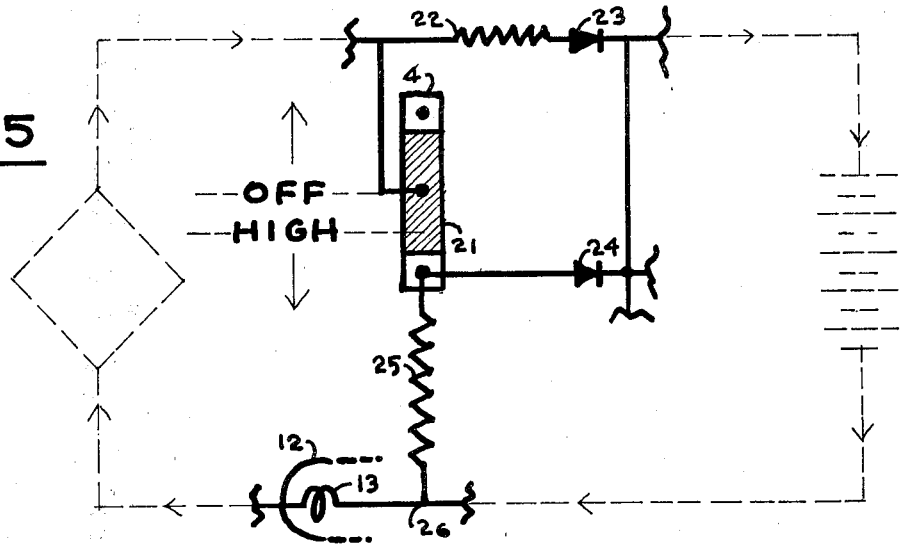
FIG. 5 A schematic drawing of modifications and additions to FIG. 4, for providing a HIGH, in lieu of a LOW, mode, wherein the filament current is substantially in excess of the correct battery charging rate.
Figure 6:
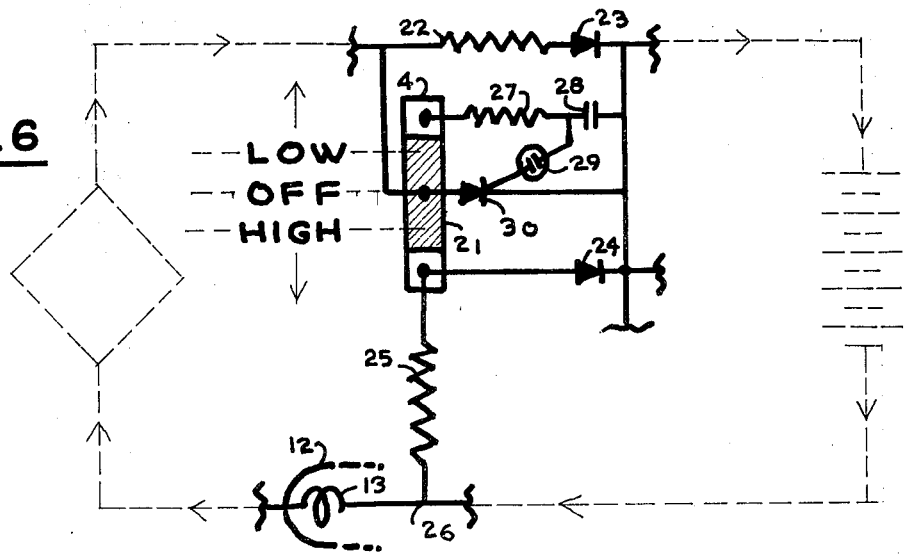
FIG. 6 A schematic drawing of modifications to FIG. 4 and FIG. 5, for providing both the HIGH, and LOW modes, as well as OFF and EMERGENCY, and maintaining the proper charging rate for both the HIGH and LOW modes.

With reference to FIGS. 4, 5, and 6, for the utility emergency lamp embodiments described herein, the device is placed in full service by fully screwing bi-filament light bulb 12 into socket 6, at which time the switching circuit, in response to voltage from battery 2, is activated in the EMERGENCY mode, inasmuch as no external power is available to the system. Battery 2

DC current flows to the cathode of diode 15, causing it to assume its high impendance state and block further current flow through the diode 15. The high impedance state of diode 15 establishes a forward bias across the emitter 16-base 17 junction of transistor 16–18, releasing current through resistor 19, thus establishing a forward bias across the base 17-collector 18 junction of transistor 16–18, allowing full current to flow through the emitter 16-collector 18 junction, and effectively switching transistor 16–18 ON. Full battery 2 current now flows to filament 14 of light bulb 12, lighting it to full intensity, and then proceeds to complete the circuit to the negative terminal of battery 2, thus establishing and functioning in the EMERGENCY mode which will sustain itself and persist until battery 2 capacity is depleted, or until other circuit changes occur, causing transistor 16–18 to revert to its high impedance state.

When female plug 8 is connected to male receptacle 5, and plug 9 is connected to covenience outlet 10, 120VAC causes current to flow to the full wave bridge rectifier 20, from where it leaves the positive terminal as unfiltered pulsating full wave DC voltage to the center terminal of switch 4, and is blocked because the wiper 21 is in the OFF position. Relatively high voltage DC current does continue to flow through resistor 22 to the anode of diode 15, causing it to assume its low impedance state by overcoming the lower voltage of battery 2, and simultaneously establishing a reverse bias across the emitter 16-base 17 junction of transistor 16–18. This reverse bias causes transistor 16–18 to switch OFF to its high impedance state across the emitter 16-collector 18 junction, and blocks any current flow to filament 14 of light bulb 12. Without current, the filament 14 is extinguished, and the EMERGENCY mode is automatically turned OFF. Meanwhile, the same relatively very low current which changed the state of diode 15 to its low impedance condition, proceeds in opposition to battery 2 voltage, through the battery 2, but without effectively charging battery 2, and continues to filament 13 of light bulb 12. Here, likewise, the current flow continues through filament 13, but it is too little to have any effect on illuminating filament 13, from where it completes the circuit to the negative terminal of rectifier 20; thus, because of the relatively high resistance of resistor 22, only enough current flows to change and sustain the reverse bias on transistor 16–18 and extinguish filament 14, but insufficient to either charge battery 2 effectively, or to illuminate filament 13; thus establishing, and functioning in the non-emergency OFF mode.

From the above, it is apparent that the deliberate manual connection and/or disconnection of the utility emergency lamp from an external power source also provides the means for intentionally switching the utility emergency lamp to a simulated EMERGENCY mode for use as a lantern.

By leaving the lamp connected to an external power source, and manually moving wiper 21 of switch 4 to the LOW position, current flow from rectifier 20 is caused to shunt around resistor 22, and on through battery 2 at a relatively much higher rate and effectively charge battery 2. This higher current rate is now limited and controlled solely by the resistance of filament 13. In addition, this higher current now illuminates filament 13 to its normal intensity, and also, the battery is under a controlled charging rate, and that heat which is inherent to the voltage drop difference between 120VDC and 6VDC is conveniently and acceptably dissipated by light bulb 12; thus, the non-emergency LOW mode is established. It is noted that the charging rate thus established will gradually bring the battery 2 up to full charge, and keep it charged even though the utility emergency lamp will regularily and in all probability be kept in the OFF (no-charge) mode for long periods on a daily basis. With reasonable instruction and use, the lamp can be left on from dusk to morning as a substantial low energy night light, and immediately following periods of extended EMERGENCY use, the lamp can safely be left on continuously for several days in order to reestablish full charge sooner than normal.

In another embodiment, FIG. 5, where a HIGH level of illumination is preferred to LOW, diodes 23 and 24, and relatively low resistor 25 are added to the circuit of FIG. 4, and circuit operation is the same, except as follows. Instead of shunting around resistor 22, current flows through wiper 21 of switch 4 to resistor 25 at a relatively very high rate to circuit junction point 26, while simultaneously, and due to the value of resistor 25, the correct amount of current flows through diode 24 in its low impedance state, then through diode 15, through battery 2, and on to circuit junction point 26; the latter current path flows at the same rate as was the case in FIG. 4. Both currents combine at circuit junction point 26, and flow to filament 13, illuminating it to its relatively very higher intensity; the combination of controlled current flow through filament 13, and the value of resistor 25 effectively regulate the charging rate of battery 2; thus establishing, and functioning in the HIGH mode.

In yet another embodiment, FIG. 6, where both the HIGH and LOW modes are desirable, resistor 27, capacitor 28, trigger device 29, and SCR 30, are added to the circuits of FIG. 4 and FIG. 5, and the circuit functions continue to be similar except as follows. The LOW mode function of FIG. 4 is not possible with light bulb 12 having a filament 13 capable of relatively very high intensity; instead, a heatless method of providing a controlled voltage drop is herein connected to the LOW position of wiper 21 of switch 4. When wiper 21 is in the LOW position, DC line current from rectifier 20 is shunted around resistor 22 to the anode of SCR 30 and to resistor 27; the combination of capacitor 28 and trigger device 29 store, build, and discharge small bursts of current to the gate of SCR 30, controlling the portion of each positive half-cycle of pulsating DC line voltage during which the SCR can fire, i.e., to change to its low impedance state and allow full current to flow during the remaining portion of a positive half-cycle. The quantity of current, or rate of flow thus released by the SCR constitutes the correct charging rate to diode 15, and battery 2. This same reduced current flow continues past junction point 26 and on to filament 13, which in turn, is now only receiving sufficient current to glow at considerably less than HIGH brilliance. Thus, the LOW mode is established and functioning in a circuit which also includes a HIGH mode capability. Uninterrupted reverse biasing of transistor 16–18 in the LOW mode, between the SCR 30 battery charging pulses, by the minimum holding-function of resistor 22.

In retrospect, several operating details were delayed until this point for the purpose of clarity, and are described as follows. The significance of both diodes 23 and 24 is to permit DC line current flow to diode 15, but on the other hand to block battery 2 current flow from the emitter 16-base 17 junction of transistor 16–18 through resistor 25, while the utility emergency lamp is functioning in the EMERGENCY mode; the latter undesireable current path would parallel resistor 19 and resistor 25, adversely affecting the operation of transistor 16–18. Capacitor 31 of FIG. 4 prevents transistor 16–18 from switching ON during the very extremely short intervals between consecutive half-wave pulses of DC line current charging the battery 2, when battery 2 DC voltage is actually higher than the charging voltage. Under other circumstances, it is the usual practice to "filter" and otherwise smooth the pulsating DC voltage with a more expensive electrolytic capacitor of much higher capacity, more bulk, and less reliability; even so, the filtering approach would not be feasible for SCR 30 application in FIG. 6, since once it turned ON, the SCR could not turn OFF between pulses if these pulses did not drop to "zero" voltage. This latter characteristic is a significant element in the U.S. patent application cross-referenced elsewhere in this specification.

Although the values and types of components utilized in the circuits shown in FIGS. 4, 5, and 6 may be selected according to the application and needs of the designer, the following list of characteristics is provided as some examples of operable embodiments:

| | FIG. 4 | FIG. 5 | FIG. 6 |
|---|---|---|---|
| Filament 13 | 6 Watt | 15 Watt | 40 Watt |
| Filament 14 | 6 Watt | 6 Watt | 6 Watt |
| Battery 2 | 1.2 Amp. Hr. | 2 Amp. Hr. | 4 Amp. Hr. |
| Emer'y Hrs. | 1 Hr. | 2 Hr. | 4 Hr. |

The disclosures and the description herein are purely illustrative and are not intended to be limiting in any sense. Many changes in construction and embodiments of the invention will be obvious to those skilled in the related arts, without departing from its scope and intent.

I claim:

1. A modular main and emergency lighting capability device for use in conventional table lamps, using a high voltage lamp filament normally operated by a main power supply, and one normally unenergized relatively very low voltage lamp filament, and having a standby battery and a switching having OFF, LOW and/or HIGH positions, including in combination:

a transistor switching means which, in its low impedance state, sends power from said battery to said low voltage filament:

a bias means which changes said transistor means to its high impedance state, stopping the flow of said power from said battery, when said high voltage filament is energized from said main power supply; means for connecting said high voltage filament in series with said battery and said main power supply whereby said battery charging current passes through said high voltage filament; means for blocking the change of said transistor means to its low impedance state momentarily, between positive full wave consecutive charging pulses of said main power supply, during the intervals when said charging pulses are lower than said battery voltage, a bleeder circuit means to pass only a relatively extremely low current through said high voltage filament to maintain said high impedance state of said transistor means while said main power supply is energized, and said high voltage filament illumination is not visible, whenever said OFF, LOW and/or HIGH switch is in the OFF position, a phase pulse width control circuit for providing reduced power from said main power supply to said high voltage filament whenever said OFF, LOW and/or HIGH switch is in the LOW position, a resistor means for shunting only the appropriate rate of said battery charging current from the total current of said high voltage filament, whenever said OFF, LOW and/or HIGH switch is in the HIGH position.

2. The device of claim 1 having said high voltage filament and said low voltage filament combined in a single glass envelope common to conventional industry single voltage bi-filament lamps.

3. The device of claim 1, having a three pole lamp socket of conventional industry configuration, except that each socket pole is directly connected to one of three corresponding terminals for connection to external circuitry.

4. The device of claim 3, having, in addition, a SPST or SPDT manual switch, for selecting OFF, LOW and/or HIGH operational modes, with each switch pole connected to corresponding terminals for connection to external circuitry.

5. The device in claim 1, having an overall circuit configuration which ensures positive readiness of the emergency mode of said device by precluding inadvertent disabling of said emergency mode by any operator manipulation of said device by other than deliberate un-screwing of the bulb containing said low voltage filament.

* * * * *